US010316396B2

(12) United States Patent
Theisen et al.

(10) Patent No.: US 10,316,396 B2
(45) Date of Patent: Jun. 11, 2019

(54) WIDE IRON-BASED AMORPHOUS ALLOY, PRECURSOR TO NANOCRYSTALLINE ALLOY

(71) Applicant: Metglas, Inc., Conway, SC (US)

(72) Inventors: Eric Alan Theisen, Conway, SC (US); Naoki Ito, Conway, SC (US); Ronald Joseph Martis, Conway, SC (US); Donald Robert Reed, Jr., Conway, SC (US); John Paul Webb, Conway, SC (US)

(73) Assignee: Metglas, Inc., Conway, SC (US)

( * ) Notice: Subject to any disclaimer, the term of this patent is extended or adjusted under 35 U.S.C. 154(b) by 137 days.

(21) Appl. No.: 14/856,023

(22) Filed: Sep. 16, 2015

(65) Prior Publication Data

US 2016/0319409 A1 Nov. 3, 2016

Related U.S. Application Data

(60) Provisional application No. 62/217,335, filed on Sep. 11, 2015, provisional application No. 62/155,160, filed on Apr. 30, 2015.

(51) Int. Cl.
*C22C 38/16* (2006.01)
*C22C 45/02* (2006.01)
(Continued)

(52) U.S. Cl.
CPC ..... *C22C 45/02* (2013.01); *C21D 1/62* (2013.01); *C22C 33/003* (2013.01); *C22C 38/16* (2013.01);
(Continued)

(58) Field of Classification Search
None
See application file for complete search history.

(56) References Cited

U.S. PATENT DOCUMENTS 4,881,989 A 11/1989 Yoshizawa et al.
5,211,767 A 5/1993 Shigeta et al.
(Continued)

FOREIGN PATENT DOCUMENTS

CN 101371321 A 2/2009
CN 103155054 A 6/2013
(Continued)

OTHER PUBLICATIONS

English translation of JP 2012-082476 (published Apr. 2012), from J-Plat Pat.*
(Continued)

*Primary Examiner* — George Wyszomierski
(74) *Attorney, Agent, or Firm* — Crowell & Moring LLP

(57) ABSTRACT

An iron-based soft magnetic alloy greater than 63.5 mm in width, a thickness between 13 and 20 microns and having a composition represented by the following formula:

$$(Fe_{1-a}M_a)_{100-x-y-z-p-q-r}Cu_xSi_yB_zM'_pM''_qX_r$$

wherein M is Co and/or Ni, M' is at least one element selected from the group consisting of Nb, W, Ta, Zr, Hf, Ti and Mo, M" is at least one element selected from the group consisting of V, Cr, Mn, Al, elements in the platinum group, Sc, Y, rare earth elements, Au, Zn, Sn and Re, X is at least one element selected from the group consisting of C, Ge, P, Ga, Sb, In, Be and As, and a, x, y, z, p, q and r respectively satisfy $0 \le a \le 0.5$, $0.1 \le x \le 3$, $0 \le y \le 30$, $1 \le z \le 25$, $5 \le y+z \le 30$, $0.1 \le p \le 30$, $q \le 10$ and $r \le 10$, the alloy being at least 50% crystalline with an average particle size of 100 nm or less. This alloy has low core loss, high permeability and low magnetostriction.

5 Claims, 2 Drawing Sheets

(51) Int. Cl.

| | |
|---|---|
| ***C21D 1/62*** | (2006.01) |
| ***H01F 1/147*** | (2006.01) |
| ***H01F 1/153*** | (2006.01) |
| ***C22C 33/00*** | (2006.01) |

(52) U.S. Cl.
CPC ..... *H01F 1/14733* (2013.01); *H01F 1/15308* (2013.01); *H01F 1/15333* (2013.01)

(56) References Cited

U.S. PATENT DOCUMENTS

| | | | | |
|---|---|---|---|---|
| 5,395,460 | A | 3/1995 | Martis | |
| 5,456,770 | A | 10/1995 | Sato et al. | |
| 6,416,879 | B1 * | 7/2002 | Sakamoto | H01F 1/15308 148/100 |
| 6,749,695 | B2 * | 6/2004 | Martis | H01F 1/15308 148/304 |
| 7,289,013 | B2 | 10/2007 | Decristofaro et al. | |
| 8,366,010 | B2 | 2/2013 | Hasegawa et al. | |
| 8,968,490 | B2 | 3/2015 | Theisen et al. | |
| 2001/0007266 | A1 | 7/2001 | Sunakawa et al. | |
| 2003/0041931 | A1 | 3/2003 | Sunakawa et al. | |
| 2006/0066433 | A1 | 3/2006 | Decristofaro et al. | |
| 2008/0196795 | A1 | 8/2008 | Waeckerle et al. | |
| 2009/0065100 | A1 | 3/2009 | Yoshizawa et al. | |
| 2011/0085931 | A1 | 4/2011 | Ohta et al. | |
| 2012/0062351 | A1 * | 3/2012 | Theisen | B22D 11/001 336/213 |
| 2013/0001314 | A1 | 1/2013 | Hasegawa et al. | |
| 2014/0283957 | A1 | 9/2014 | Zhou et al. | |

FOREIGN PATENT DOCUMENTS

| | | | |
|---|---|---|---|
| EP | 2 757 172 | A1 | 7/2014 |
| JP | 6-17204 | A | 1/1994 |
| JP | 7-300657 | A | 11/1995 |
| JP | 2007-182594 | A | 7/2007 |
| JP | 2010-229466 | A | 10/2010 |
| JP | 2012-82476 | A | 4/2012 |
| JP | 2013-67863 | A | 4/2013 |
| JP | 2013-185162 | A | 9/2013 |
| JP | 2013-541642 | A | 11/2013 |

OTHER PUBLICATIONS

English translation of JP 2013-185162 (published Sep. 2013), from J-Plat Pat.*

Japanese Office Action issued in counterpart Japanese Application No. 2015-204379 dated Aug. 25, 2016, with English translation (nineteen (19) pages).

Japanese-language Office Action issued in counterpart Japanese Application No. 2015-204379 dated May 17, 2017 with English translation (3 pages).

International Search Report (PCT/ISA/210) issued in PCT Application No. PCT/US2015/051192 dated Dec. 21, 2015 (two (2) pages).

Written Opinion (PCT/ISA/237) issued in PCT Application No. PCT/US2015/051192 dated Dec. 21, 2015 (five (5) pages).

European Search Report issued in counterpart European Application No. 15186430.3 dated Nov. 25, 2015 (seven pages).

Chinese-language Office Action issued in counterpart Chinese Application No. 201510679506.4 dated Jul. 19, 2017 with partial English translation (10 pages).

European Office Action issued in counterpart European Application No. 15 186 430.3 dated Oct. 5, 2017 (three pages).

Chinese-language Office Action issued in counterpart Chinese Application No. 201510679506.4 dated Mar. 13, 2018 with English translation (10 pages).

Indian-language Examination Search Report issued in counterpart India Application No. 3018/DEL/2015 dated Jul. 6, 2018 with English translation (six (6) pages).

European Office Action issued in counterpart European Application No. 15 186 430.3 dated May 7, 2018 (three pages).

Chinese-language Office Action issued in counterpart Chinese Application No. 201510679506.4 dated Jan. 11, 2019 with English translation (six (6) pages).

* cited by examiner

WIDE IRON-BASED AMORPHOUS ALLOY, PRECURSOR TO NANOCRYSTALLINE ALLOY

TECHNICAL FIELD

The present invention relates to an iron based nanocrystalline soft magnetic alloy ribbon whose width is greater than 63.5 mm. The as-cast amorphous alloy is heat treated to obtain a nanocrystalline structure. Such a heat-treated ribbon may be used in current sensors, saturation inductors, transformers, magnetic shielding and various other power conditioning devices.

BACKGROUND

Many manufacturers, such as Hitachi Metals and Vacuumschmelze sell amorphous alloy ribbon, which is precursor to nanocrystalline alloy, with a maximum width up to 63.5 mm. The current maximum width is limited by the casting technology, which results in poor magnetic properties, large thickness variations across the width of the ribbon and poor winding capability during casting.

There is significant demand for nanocrystalline foil alloys used in power electronic devices. The low loss properties for nanocrystalline ribbon make them suitable for a wide range of high frequency (kHz) transformer applications. The nanocrystalline ribbon is also used in choke coils to reduce high frequency harmonics. The nanocrystalline ribbon can also be used in pulsed power applications.

The nanocrystalline alloys are produced through a planar flow casting process where molten metal is fed onto a rotating quench wheel where the metal is rapidly cooled into an amorphous state at cooling rates on the order of $10^{6\circ}$ C./sec. The preferred thickness for the as-cast ribbon is between 13 and 20 microns. The linear speeds of the rotation quench wheel are typically between 25 and 35 m/s. The ribbon is cast continuously and stripped from the quench wheel and mechanically conveyed onto a large spool moving at the same speed where it is continuously wound.

Conventional iron-based fully amorphous alloys are commonly used in transformer cores, and the ribbon is available at widths of 5.6", 6.7" and 8.4" at a thickness of 25 microns. This nanocrystalline alloy being of only 13 to 20 microns in thickness makes catching and winding the ribbon very difficult at widths beyond 63.5 mm. The relative thinness of the ribbon makes it difficult to mechanically catch the ribbon at high speeds without breaking it, and, therefore, the ribbon cannot be wound continuously onto a spool.

The thickness uniformity in the width direction also limits the ability to continuously wind the ribbon onto a spool. Thickness variations can cause the spool to wind poorly as the spool builds due to high and low sections of the ribbon progressively overlapping. For example, a spool consisting of ribbon with large thickness variation across the width will be very loose where the ribbon is thinner and very tight where the ribbon is thicker causing the ribbon to easily break during winding.

The difficulty in continuously winding the ribbon is one of the reasons that wider nanocrystalline alloys are not commercially available. While it is possible to cast the ribbon and wind onto a spool in two distinct stages, this is difficult as a practical matter because it introduces many folds and wrinkles into the ribbon that can detract from the soft magnetic performance. Continuous casting and synchronous winding of the ribbon is also need to reduce the cost to produce the ribbon because it eliminates the intermediate processing steps.

The fully amorphous ribbon is then heat treated into a nanocrystalline state. U.S. Pat. No. 4,881,989 entitled "Fe-base soft magnetic alloy and method of producing same", the contents of which are incorporated by reference, discloses the physics of the transition from amorphous as-cast ribbon into a nanocrystalline alloy during heat treatment.

The narrow available width limits the applications to mainly small tape wound core materials. Producing a wide high frequency transformer currently requires stacking multiple narrow wound cores together. The narrow ribbon width also limits the production rates of the nanocrystalline ribbon which keeps the cost of the ribbon prohibitively high for many applications. The thickness of the foil being less than 20 microns makes winding ribbons greater than 63.5 mm difficult, and such wider ribbon is not commercially available.

SUMMARY OF THE INVENTION

In light of the disadvantages of current technologies, the object of the current invention is to provide an iron-based precursor ribbon with thicknesses between 13 and 20 microns and widths greater than 63.5 mm capable of being heat treated into a nanocrystalline state with excellent soft magnetic properties, and to provide a manufacturing method to produce ribbon wider than 63.5 mm.

To achieve the above-stated objectives, the present invention involves the following technical solutions:

An iron-based precursor ribbon of thicknesses between 13 and 20 microns and widths greater than 63.5 mm capable of being heat treated into a nanocrystalline state with soft magnetic properties where the saturation magnetic flux density is greater than 1.15 T, and the initial permeability tested at 1 kHz is greater than 75000. In addition, a manufacturing method is disclosed to produce ribbon wider than 63.5 mm. The ribbon thickness is preferably between 13 and 20 microns with 16 to 18 microns being more preferred. The ribbon thickness uniformity across the width direction preferably shows variations less than +/−15% of the total ribbon thickness. Standard amorphous ribbon of 25 micron thicknesses are available at 5.6", 6.7" and 8.4" widths. The precursor nanocrystalline ribbon of the present invention with a thickness of between 13 and 20 microns can also be cast at these widths. The precursor nanocrystalline ribbon of the present invention can be cast at widths ranging from 63.5 mm to as wide as the machine which is producing it will allow.

The composition of the wide Fe-based soft magnetic alloy has a composition represented by the following formula: $(Fe_{1-a}M_a)_{100-x-y-z-p-q-r}Cu_x Si_y B_z M'_p M''_q X_r$, wherein M is Co and/or Ni, M' is at least one element selected from the group consisting of Nb, W, Ta, Zr, Hf, Ti, and Mo; M" is at least one element selected from the group consisting of V, Cr, Mn, Al, elements in the platinum group, Sc, Y, rare earth elements, Au, Zn, Sn, and Re; X is at least one element selected from the group consisting of C, Ge, P, Ga, Sb, In, Be, and As; and a, x, y, z, p, q and r respectively satisfy $0 \le a \le 0.5$, $0.1 \le x \le 3$, $0 \le y \le 30$, $1 \le z \le 25$, $5 \le y+z \le 30$, $0.1 \le p \le 30$, $q \le 10$ and $r \le 10$, the alloy being at least 50% crystalline with an average particle size of 100 nm or less. Preferred compositions of the wide Fe-based soft magnetic alloy are ones which satisfy: $0 \le 0.05$, $0.8 \le x \le 1.1$, $12 \le y \le 16$, $6 \le z \le 10$, $1 \le p \le 5$, $q \le 1$ $r \le 1$. Additionally, in preferred compositions of the wide Fe-based soft magnetic alloy, M' is Nb or Mo.

The alloy is preferably produced using single roller quenching. In one embodiment, the alloy is produced using a planar-flow melt spinning process where melting the raw materials occurs in a coreless induction melting furnace producing a molten alloy of uniform composition. The molten metal is transferred to a holding furnace that holds the molten metal and feeds the liquid continuously through a ceramic nozzle onto a rotating quenching wheel. The quenching wheel is internally water cooled to remove the heat from the ribbon. The ceramic nozzle is close enough to the rotating wheel that the molten metal forms a puddle bridging the nozzle and the wheel. A continuous ribbon is pulled from the molten metal puddle and the ribbon rapidly cools while in contact with the wheel.

The uniformity of the thickness across the width direction of the ribbon depends on the ability to flow molten metal evenly along the width direction of the ceramic nozzle. The parameters that influence the molten metal flow rate are the gap spacing between the nozzle and the wheel, the slot dimension along the width of the nozzle, and the metallostatic pressure between the furnace and the nozzle.

Thermal deformation to the quench wheel surface occurs between the start of the casting process where the quench wheel is at room temperature to steady state processing where heat is being conducted through the wheel. The thermal deformation of the quench wheel causes a variation between the gap spacing of the nozzle and the wheel. The ceramic nozzle is mechanically pinned at various locations along the width direction to modify the slot opening of the nozzle to compensate for the wheel thermal deformation during the transient period before reaching steady state. The mechanical pinning of the nozzle slot in multiple places maintains a uniform molten metal flow and uniform thickness in the ribbon width direction. This allows for the ribbon width to be greater than 63.5 mm.

The ribbon is mechanically removed from the wheel using an airflow stripper. The ribbon forms a wrap angle of approximately 180 degrees with the quenching wheel allowing for the ribbon to cool to below 250° C. The quenching surface is continuously polished during casting to keep the surface clean with an average roughness Ra less than 1 micron.

After the ribbon is removed from the quench wheel a mechanical spinning, dual counter rotating brush system catches the ribbon and transfers it onto a winding spool. The brush system then transfers the ribbon to a winding station where it is transferred to onto a spool that is moving at the same speed as the rotating quench wheel.

The thickness of the ribbon being only 13 to 20 microns in thickness makes it easy for the ribbon to mechanically break during the transfer of the ribbon between the quench wheel and the winder. A modified dual brush system that uses ultra-fine wire bristles is used to minimize ribbon break out during the transfer to the winder.

The winder geometry is also modified to run ribbon between 13 and 20 microns. The winder must move at the same speed as the quench wheel so it is preferable that the airflow surrounding the winder be minimized to prevent any non-uniform forces on the ribbon that will cause it to break.

DETAILED DESCRIPTION OF THE DRAWINGS

The invention will be described in further detail in combination with the figures and embodiments.

Figure 1:
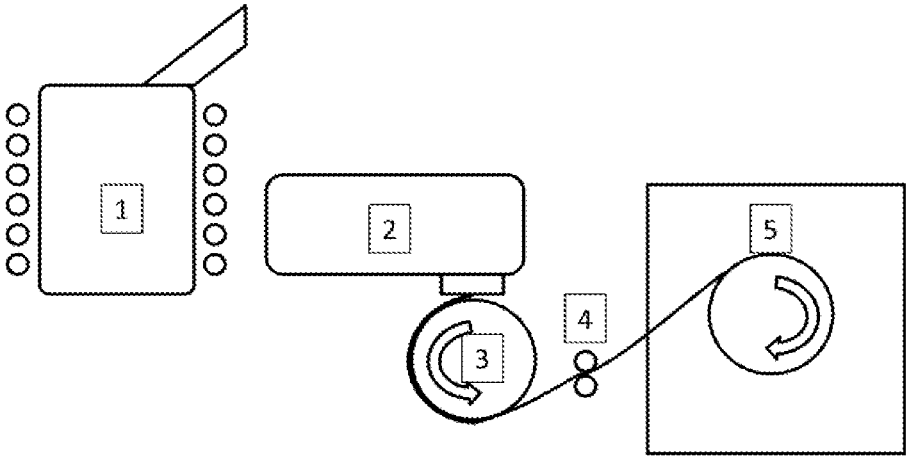
FIG. 1—schematic of manufacturing method of the iron based amorphous precursor ribbon of the present invention where 1 is the induction melting furnace, 2 is the holding furnace, 3 is the rotating quench wheel, 4 is the thread up brush and 5 is the winder and spool.

For the composition of the iron-based amorphous alloy cast as a precursor to the nanocrystalline ribbon, the raw materials consist of pure iron, ferroboron, ferrosilicon, ferroniobium, and pure copper. These raw materials are melted in an induction furnace preferably heated to 1400° C. where the molten metal is held and refined, allowing for incidental impurities to rise to the top of the melt, which can be removed as solid slag as shown in FIG. 1 step 1. The molten metal is then transferred to a holding furnace as shown in FIG. 1 step 2.

The molten metal is fed from the holding furnace through the ceramic casting nozzle with a controlled constant pressure flow rate. The nozzle to quench wheel distance is preferably between 150 and 300 microns in distance. The molten metal puddle bridges this gap and a stable molten puddle is formed from which the metal solidifies and a continuous ribbon is cast as shown in FIG. 1 step 3.

The ribbon is removed from the quench wheel and caught in a thread-up brush as shown in FIG. 1 step 4. The ribbon is then transferred at a synchronous speed of the quench wheel rotation to the winding device as shown in FIG. 1 step 5.

Figure 2:
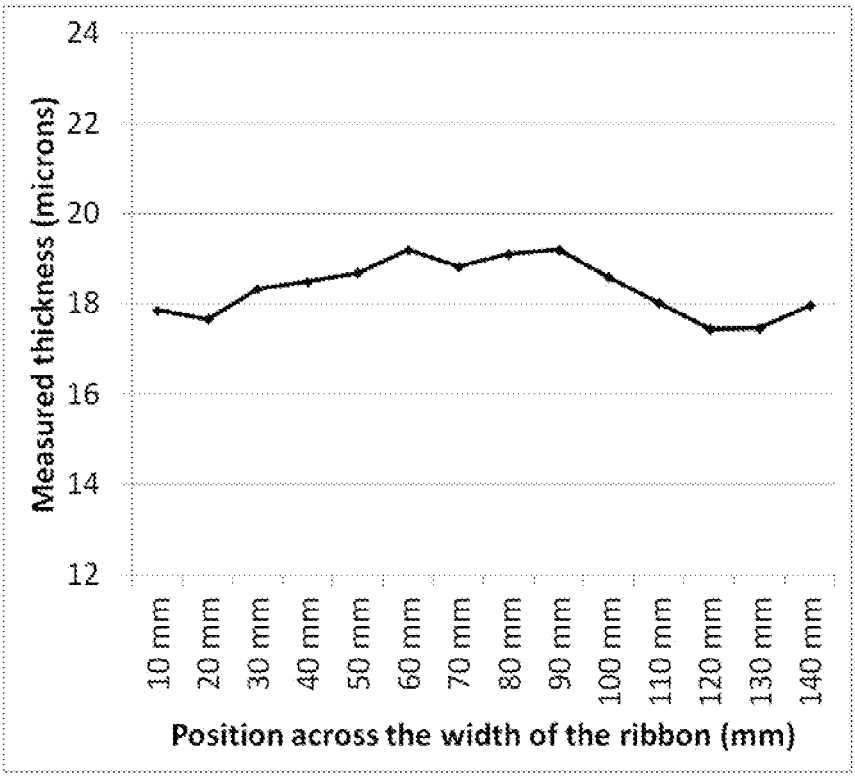
FIG. 2—plot of thickness variation in the width direction of ribbon when using the nozzle slot expansion control methods of the present invention.
Figure 3:
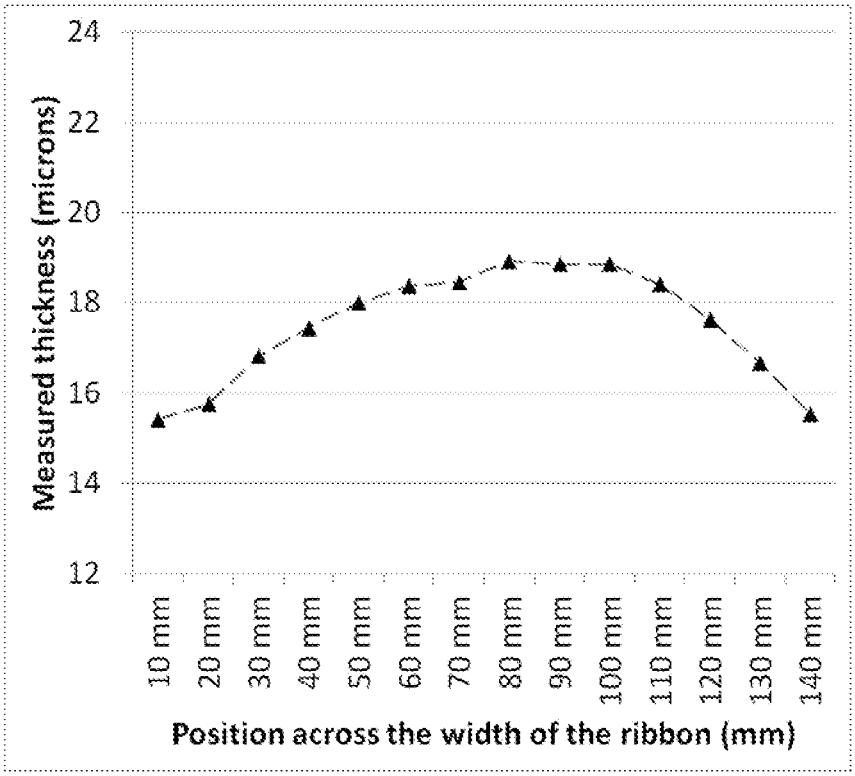
FIG. 3—plot of thickness variation in the width direction of ribbon when using the using the prior art without accounting for the thermal deformation of the nozzle and casting wheel.

The recommended casting speed is preferably between 25 and 35 m/s with 28 to 30 m/s being more preferred. The ribbon thickness is preferably between 13 and 20 microns with 16 to 18 microns being more preferred. The ribbon thickness uniformity across the width direction preferably shows variations less than +/−15% of the total ribbon thickness. FIG. 2 shows the typical thickness of the cast ribbon measured with a 1 cm anvil checked at 1 cm intervals across the width direction of the ribbon. The ceramic nozzle is preferably mechanically clamped at various positions across the nozzle width to control the nozzle slot opening such that it matches the quench wheel deformation and maintains a flat ribbon profile. FIG. 3 shows a similar cast ribbon profile when the nozzle is not mechanically clamped and large thickness variations occur across the width to the center of the ribbon.

The nozzle could also be contoured to match the quench wheel shape to minimize ribbon profile variations. Here, the gap height spacing between the nozzle and the wheel is controlled to maintain a flat ribbon profile. However, clamping the nozzle is preferred due to the added labor and machining needed to contour the shape into the nozzle.

Through implementing the technical solutions of the present solution the iron base amorphous precursor ribbon of width greater than 63.5 mm can be heat treated into a nanocrystalline state with excellent soft magnetic properties. The ribbon shown in FIG. 2 was slit from the parent material of 142 mm was slit at widths of 20 mm from the center and from each edge and formed into small toroids for magnetic testing. The ribbon was annealed in a furnace at 550° C. for one hour to induce the nanocrystalline state.

Table 1 shows the resulting average magnetic properties of the three toroids and the variation between the edge and center portion of the ribbon after being annealed at 550 degrees C. in an inert atmosphere oven. The average induction levels at an applied field of 800 A/m is 1.2 T with a variation of on 0.5 T. The coercivity is 0.71 A/m with a variation of 0.25 A/m. The permeabilities are 104000, 75000, and 13000 with variation of 10000, 5000, and 3000 when tested at 1 kHz, 10 kHz, and 100 kHz respectively.

TABLE 1

Magnetic properties of the nanocrystaline toroidal cores with typical variability across the cast width direction for an embodiment of the present invention.

| Toroid Wt. (g) | B800 (T) | Hc (A/m) | μ @ 1 kHz | μ @ 10 kHz | μ @ 100 kHz |
|---|---|---|---|---|---|
| 11 +/− 0.5 | 1.2 +/− 0.05 | 0.71 +/− 0.25 | 104000 +/− 10000 | 75000 +/− 5000 | 13000 +/− 3000 |

Table 2 shows the chemical composition in weight percent, the ribbon width and thickness of an embodiment of the present invention.

TABLE 2

Ribbon chemistry, width and thickness for an embodiment of the present invention.

| Alloy chemistry (wt %) | Ribbon width (mm) | Ribbon Thickness (microns) |
|---|---|---|
| Fe83Si8.6B1.4Nb5.5Cu1.3 | 142 | 18 |

Table 3 shows the chemical composition in weight percent, the ribbon width and thickness of an embodiment of the present invention.

TABLE 3

Ribbon chemistry, width and thickness for an embodiment of the present invention.

| Alloy chemistry (wt %) | Ribbon width (mm) | Ribbon Thickness (microns) |
|---|---|---|
| Fe83Si8.6B1.4Nb5.5Cu1.3 | 142 | 18 |
| Fe83Si8.6B1.4Nb5.5Cu1.3 | 142 | 15 |
| Fe83Si8.6B1.4Nb5.5Cu1.3 | 216 | 18 |
| Fe79.5Si6.2B2.1Nb5.2Cu1.3Ni5.9 | 142 | 18 |
| Fe83Si8.6B1.4Mo5.6Cu1.3 | 51 | 17 |

Table 4 shows the chemistry and crystallization temperatures for the initial and secondary stages for an embodiment of the present invention. Typically the ribbon is wound into a toroidal core or slit and stacked into a shape and possibly impregnated with glue in an electronic application. The core or stacked shape is then annealed at a temperature above the onset crystallization point but below the secondary crystallization point to induce the nanocrystalline phase.

TABLE 4

Ribbon chemistry and crystallization temperatures for the initial and secondary stages for an embodiment of the present invention.

| Alloy chemistry (wt %) | Onset Crystallization T (C.) | Secondary Crystallization T (C.) |
|---|---|---|
| Fe83Si8.6B1.4Nb5.5Cu1.3 | 540 | 650 |
| Fe79.5Si6.2B2.1Nb5.2Cu1.3Ni5.9 | 530 | 650 |
| Fe83Si8.6B1.4Mo5.6Cu1.3 | 515 | 650 |

The invention claimed is:

1. A nanocrystalline alloy formed by annealing an iron-based amorphous alloy, the iron-based amorphous alloy comprising:

a composition represented by the following formula:

$$(Fe_{1-a}M_a)_{100-x-y-z-p-q-r}Cu_xSi_yB_zM'_pM''_qX_r$$

wherein

M is Co and/or Ni;

M' is at least one element selected from the group consisting of Nb, W, Ta, Zr, Hf, Ti, and Mo;

M" is at least one element selected from the group consisting of V, Cr, Mn, Al, elements in the platinum group, Sc, Y, rare earth elements, Au, Zn, Sn, and Re;

X is at least one element selected from the group consisting of C, Ge, P, Ga, Sb, In, Be, and As; and a, x, y, z, p, q and r respectively satisfy $0 \le a \le 0.5$, $0.1 \le x \le 3$, $0 \le y \le 30$, $1 \le z \le 25$, $5 \le y+z \le 30$, $0.1 \le p \le 30$, $q \le 10$ and $r \le 10$, wherein the iron-based amorphous alloy is manufactured using single roller quenching, wherein the iron-based amorphous alloy has a width greater than 63.5 mm, a thickness in the range of 13 to 20 μm, wherein the thickness variation across the width direction of the iron-based amorphous alloy is less than +/−15% of the total thickness, and wherein the nanocrystalline alloy has a nanocrystalline structure and a saturation magnetic induction greater than 1.15 T.

2. The nanocrystalline alloy of claim 1, wherein the iron-based amorphous alloy has at least two crystallization events or temperatures and wherein the nanocrystalline alloy has a crystalline particle size less than 100 nm formed after annealing the iron-based amorphous alloy between a first crystallization temperature and a second crystallization temperature.

3. The nanocrystalline alloy of claim 1, comprises a portion of a device selected from the group consisting of saturation inductors or magnetic switches, electromagnetic interference filters, transformers, current sensors, and ground fault current interrupt sensors.

4. A method for manufacturing a nanocrystalline alloy, the method comprising:

selecting a composition represented by the following formula:

$$(Fe_{1-a}M_a)_{100-x-y-z-p-q-r}Cu_xSi_yB_zM'_pM''_qX_r$$

wherein

M is Co and/or Ni;

M' is at least one element selected from the group consisting of Nb, W, Ta, Zr, Hf, Ti, and Mo;

M" is at least one element selected from the group consisting of V, Cr, Mn, Al, elements in the platinum group, Sc, Y, rare earth elements, Au, Zn, Sn, and Re;

X is at least one element selected from the group consisting of C, Ge, P, Ga, Sb, In, Be, and As; and a, x, y, z, p, q and r respectively satisfy $0 \le a \le 0.5$, $0.1 \le x \le 3$, $0 \le y \le 30$, $1 \le z \le 25$, $5 \le y+z \le 30$, $0.1 \le p \le 30$, $q \le 10$ and $r \le 10$, quenching using a single roller to obtain an iron-based amorphous alloy having a width greater than 63.5 mm, a thickness in the range of 13 to 20 μm, a thickness variation across the width direction of the iron-based amorphous alloy of less than +/−15% of the total thickness, and annealing the iron-based amorphous alloy to obtain a nanocrystalline alloy having a nanocrystalline structure and a saturation magnetic induction greater than 1.15 T.

5. The method of claim 4, wherein the iron-based amorphous alloy has at least two crystallization events or temperatures and wherein the nanocrystalline alloy has a crystalline particle size less than 100 nm formed after annealing the iron-based amorphous alloy between a first crystallization temperature and a second crystallization temperature for a time varying between 10 seconds to 4 hours.

* * * * *